United States Patent [19]

Desanta

[11] Patent Number: 4,640,548

[45] Date of Patent: Feb. 3, 1987

[54] CHAIR WITH AN ADJUSTABLE BACKREST

[75] Inventor: Simon Desanta, Gutersloh, Fed. Rep. of Germany

[73] Assignee: Kusch & Co. Stizmobelwerke KG, Hallenberg, Fed. Rep. of Germany

[21] Appl. No.: 542,875

[22] Filed: Oct. 17, 1983

[30] Foreign Application Priority Data

Oct. 3, 1981 [DE] Fed. Rep. of Germany ..... 3139448

[51] Int. Cl.[4] ..... A47C 1/032

[52] U.S. Cl. ..... 297/320; 297/301; 297/304; 297/322

[58] Field of Search ..... 297/304, 300, 301, 316, 297/320, 322

[56] References Cited

U.S. PATENT DOCUMENTS

| | | | |
|---|---|---|---|
| 3,133,765 | 5/1964 | Kramer | 297/445 |
| 3,224,807 | 12/1965 | Welch et al. | 297/304 |
| 4,057,214 | 11/1977 | Harder, Jr. | 297/300 X |
| 4,065,176 | 12/1977 | Fontana | 297/304 |
| 4,143,910 | 3/1979 | Geffers et al. | 297/320 X |
| 4,384,741 | 5/1983 | Flum et al. | 297/304 |

FOREIGN PATENT DOCUMENTS

| | | | |
|---|---|---|---|
| 1957493 | 5/1971 | Fed. Rep. of Germany | 297/300 |
| 622620 | 5/1949 | United Kingdom | 297/300 |

*Primary Examiner*—Francis K. Zugel
*Assistant Examiner*—Peter R. Brown
*Attorney, Agent, or Firm*—Cushman, Darby & Cushman

[57] ABSTRACT

An adjustable chair, especially an office chair, includes a column (32), a seat (34), a backrest (36), supported by a curved supporting bar (40). Three horizontal transverse axes (44, 46, 48) connect the seat and the column, the column and the curved supporting bar and the curved supporting bar and the seat in one hinged triangular arrangement where at least one transverse axis permits not only a swiveling motion but also a relative shift of the connected parts to permit an adjustment of the seat and backrest. At least one of the transverse axes of this type consists of at least one rubber pad (46, 48).

9 Claims, 3 Drawing Figures

CHAIR WITH AN ADJUSTABLE BACKREST

BACKGROUND AND SUMMARY OF THE PRESENT INVENTION

This invention concerns a chair, especially an office chair, with a vertical column, a seat mounted on this column and a backrest that is connected to said column by a curved supporting bar plus three horizontal transverse axes which connect the chair and the column, the column and the curved supporting bar and the curved supporting bar and the seat in a hinged triangular arrangement and at least one of the transverse axes permits a relative shift in the connected parts.

The adjustment mechanism of such a chair is essentially known to the present applicant from European Patent Application No. 80 100456.5. It offers the advantage that the seat and the backrest can be moved simultaneously, i.e., with a handle, and in this movement the backrest covers a greater distance than the seat, as is desirable in adjustable chairs for reasons of comfort and ergonomy. The known adjusting mechanism, however, can be regarded as a disadvantage at least inasmuch as the three required transverse axes are relatively massive and expensive to produce if premature wear is to be avoided, which would lead to an unpleasant and insecure sensation on sitting in the chair. Special difficulties in this regard can arise in manufacturing a transverse axis which permits a parallel shift with respect to itself. These difficulties are not insurmountable, but they do lead to a rather complex design which may also require a certain amount of care which is not justified in all cases.

This invention is therefore based on the goal of designing a chair of this type which will permit a simple and sturdy construction while maintaining the ergonomic and technical handling advantages of the known solution.

This goal is achieved according to this invention with a chair of the type described initially where at least one of the transverse axes which connects the seat with the column and the curved supporting bar is formed by rubber pads which support the chair on the column and/or the curved supporting bar.

Rubber pads in the present connection are understood to refer to elastomer blocks of a rubbery material without being limited to rubber in the narrower sense. Rubber-metal composite constructions are also possible. Rubber pads as understood in this sense permit the relatively slight swiveling movements of the seat with respect to the column and the curved supporting bar of the backrest while also absorbing the shifting movements in displacement of the above-mentioned hinged triangular arrangement as will be discussed again below with reference to the figure.

In a preferred version, the two transverse axes connecting the seat with the column and the curved supporting bar are formed by rubber pads which offer the additional advantage that they support the seat with a certain spring action. The rubber pads may be attached by means of screws, glue or some other means.

With the preferred design described above, the usual axial bearing is necessary only for one horizontal transverse axis, namely the horizontal transverse axis between the curved supporting bar of the backrest and the column. The swiveling movement of the curved supporting bar about this transverse axis can preferably be stopped in various angle positions. This offers the possibility of adjusting the backrest as well as the seat in various angle positions. This locking in a given position can be accomplished with the help of a catch which engages a toothed segment or a pin which engages a plate segment which has holes, or by some other mechanical means, or even with the help of a pneumatic spring.

Preferably, the curved supporting bar of the backrest and thus also the seat are subject to a pretension acting toward the front of the chair by means of a rubber buffer which functions as a spring. This rubber buffer is located in a suitable position between the column or a projecting arm which projects forward from the column and the curved supporting bar.

BRIEF DESCRIPTION OF THE FIGURES

Prererred practical examples of the present invention are explained below with reference to the accompanying figures.

DETAILED DESCRIPTION OF THE PRESENT INVENTION

Figure 1:
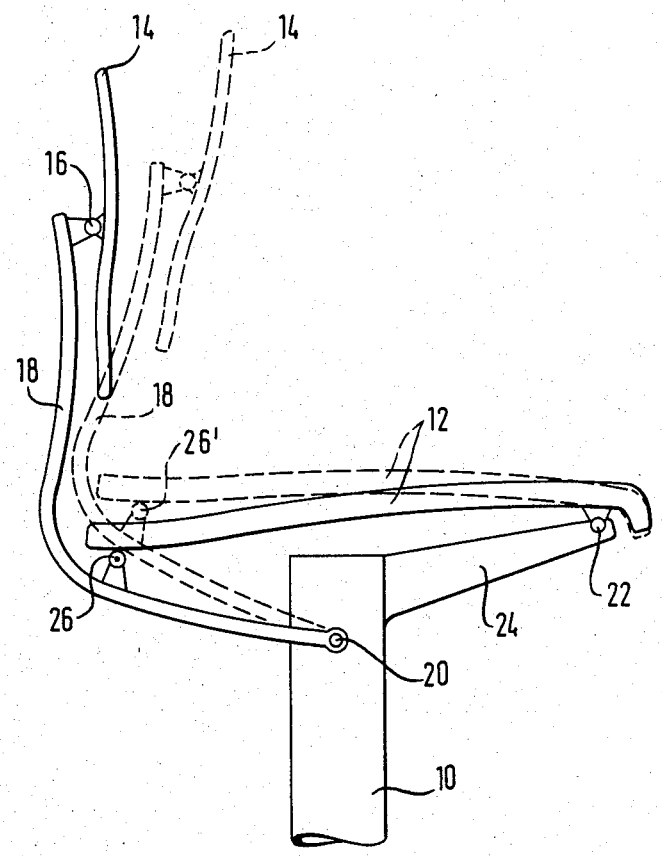
FIG. 1 shows a schematic diagram to illustrate the adjustment mechanism of a chair according to this invention.

The chair shown in FIG. 1 includes a column pin which starts from a roller carriage, base, etc. (not shown), a seat (12) and a backrest (14). At the rear of the backrest (14) it is connected in the usual way via a hinged joint (16) with the upper end of a curved supporting bar which includes an upper section which is essentially vertical and a lower section which is essentially horizontal and is connected to the former with a curve. The free end of the lower horizontal section is supported in a horizontal transverse axis (20) at the upper end of the column (10). The curved supporting bar (18) can therefore swivel about this horizontal transverse axis (20) with the backrest (14).

At the front edge of the seat (12) and beneath it there is a second horizontal transverse axis (22) above which the seat (12) is supported on the front end of a projecting arm (24) which projects from the upper end of the column (10) so the seat can swivel.

A third horizontal transverse axis (26) connects the lower rear side of the seat (12) with the adjacent area of the curved supporting bar (18).

Horizontal transverse axes in the present connection are understood to refer to swivel axes or hinged joints whose axial direction is horizontal and across the seating direction of the person sitting in the chair.

The transverse axes (20, 22, 26) form a hinged triangular arrangement in which the angles and/or side length can be varied with the main chair mechanism due to the fact that at least one of the transverse axes permits not only a swiveling movement between the connected parts but also permits a relative shift between them. In the example illustrated here, the horizontal transverse axis (26) at the lower rear side of the seat (12) moves forward with respect to the seat (12) when the seat (12) and the backrest (14) move into the forward position shown with a dotted line. This altered position of the transverse axis (26) at the lower side of the seat (12) is indicated with (26'). In this position, the side length (22–26') is shortened while the side lengths (20–26') and (20–22) are unchanged. It is immediately apparent that in moving to the position indicated with a dotted line, the curved supporting bar (18) and the backrest (14) execute a larger swivel angle than the seat (12). The backrest is therefore adjusted to a greater extent than the seat. This is quite desirable in the corresponding adjusting operations, e.g., between a working position leaning forward and a resting position leaning backward.

Figure 2:
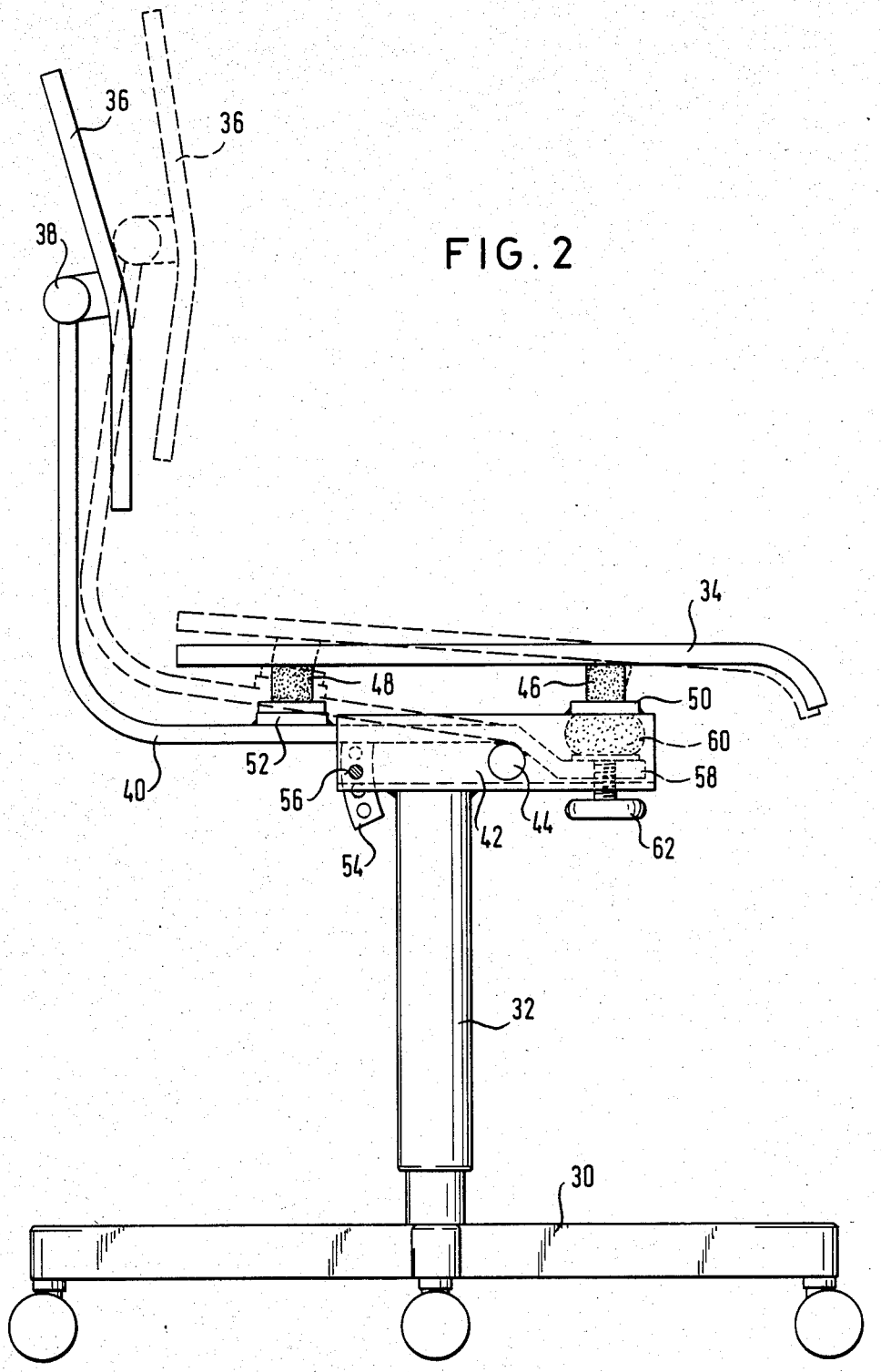
FIG. 2 shows a side view, partially cut open, of one version of the chair according to this invention.
Figure 3:
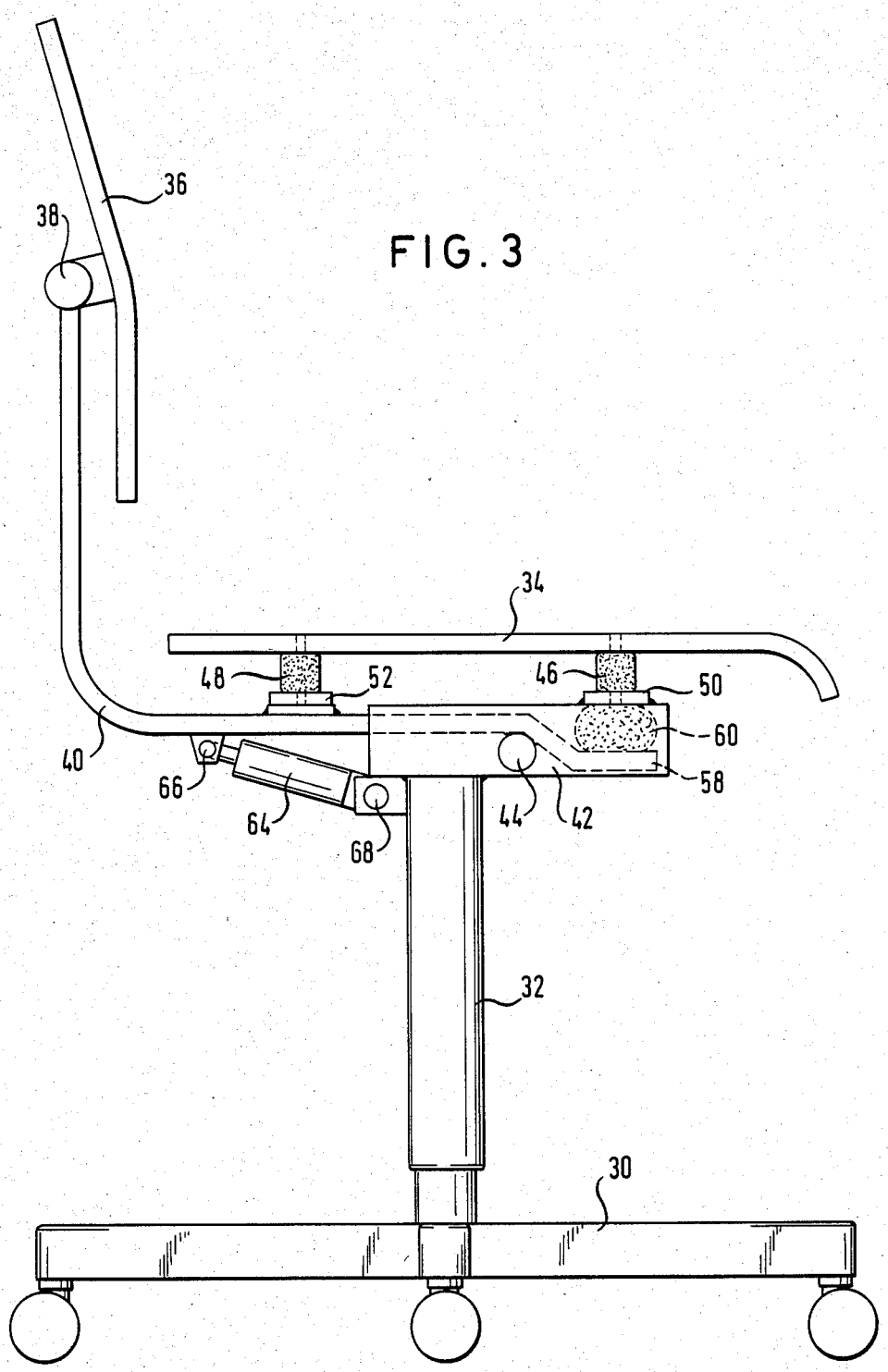
FIG. 3 shows a corresponding diagram of one version of this chair.

FIGS. 2 and 3 show two versions of this invention in which the kinematics described above can be achieved with considerably simpler means.

FIG. 2 shows a chair with a roller base framework (30), a column (32), a seat (34) and a backrest (36). The backrest (36) is connected via a hinged joint (38) with the upper end of the curved supporting bar (40) so that the backrest can move. At the upper end of the column (32) there is a projecting arm (42) which may point forward and may have approximately the shape of a U section that is open at the top. The curved supporting bar (40) is supported at its lower front end on the projecting arm (42) so that it can swivel in a horizontal transverse axis (44), which corresponds to the transverse axis (20) according to FIG. 1. The two other horizontal transverse axes (22) and (26) according to FIG. 1 are replaced in FIG. 2 by rubber pads. The rubber pad (46) connects the front lower side of the seat (34) with a plate (50) that is attached to the front end of the projecting arm (42). The rubber pad (48) connects the lower rear side of the seat (34) via spacers (52) with the adjacent top side of the curved supporting bar (40).

When the backrest (36) is moved forward or when the rear side of the seat (34) is lifted into the position shown with a dotted line, this again results in the shift in the hinged triangular arrangement (44, 46, 48) as explained with regard to FIG. 1. In doing so, the rubber pads (46) and (48) not only permit a limited swiveling movement between the seat (34) and the projecting arm (42) on the one hand and between the seat (34) and the curved supporting bar (40) on the other hand, but they also absorb the reduction in distance which occurs between the plate (50) at the front end of the projecting arm (42) and the intermediate pieces (52) on the curved supporting bar (40). There are thus two hinged joints or transverse axes which permit a relative shift between the connected part at the same time.

Although there is only one rubber pad (46) and one (48) in FIG. 2, both the spacers (52) as well as the plate (50) can be elongated at a right angle to the plane of the drawing and include at least two rubber pads, so the seat (34) is prevented from tilting to the side.

On the lower side of the curved supporting bar (40) there is a curved plate (54) which has a number of holes, such that the individual holes can each be aligned with a horizontal hole (46) which passes through the rear end of the projecting arm (42) in the transverse direction to receive a locking pin. Due to this locking effect, the seat (34) and the backrest (36) are locked in position together. The adjustment of the chair mechanism can therefore be made with a handle and with the help of a single lever.

Office chairs of the present type generally have a spring support for the backrest and/or the seat in the resting position inclined backward. Therefore, a rubber buffer (60) is provided between the plate (50) and an extension (58) of the curved supporting bar (40) which extends forward beyond the horizontal transverse axis (44), such that the rubber buffer provides a pretension for the seat and the backrest in the position indicated with the dotted lines. The spring action (60) is adjustable with the help of a handwheel (62). This type of spring suspension is considerably simpler than the traditional steel springs, etc.

The version illustrated in FIG. 3 is essentially the same as that in FIG. 2, so that corresponding parts have the same reference numbers and need not be explained again. The only difference here is that the plate (54) with holes according to FIG. 2 is omitted and instead a pneumatic spring (64) has been provided. The pneumatic spring (64) is attached with one end to the lower side of the curved supporting bar (40) by means of a hinged joint (66) and at the other end is attached by means of another hinged joint (68) to the upper rear side of the column (32). It preferably contains a locking mechanism (not shown).

This invention can also be implemented so that only one of the rubber pads (46) or (48) is used while the other is designed as a traditional horizontal transverse axis. In any case, the advantage here is that the rubber pads (46) and (48) provide a spring support for the seat (34).

Instead of the rubber buffer (60), a steel spring or some other elastic part can also be used.

I claim:

1. A chair, especially an office chair, having a vertical column with a seat mounted on said column and a backrest connected to said column by a curved supporting bar, means defining three hinge points, each having a horizontal transverse axis, for respectively connecting the seat and the column, the column and the supporting bar and the supporting bar and the seat in a hinged triangular arrangement, wherein, when said backrest is reclined, said hinge point connecting the seat and the supporting bar is simultaneously vertically moved horizontally shifted between the seat and the supporting bar, wherein said hinge points connecting the seat and the column on the one hand and the seat and the supporting bar on the other hand, respectively, are formed by rubber pads, whereby seat movement is divided into a shifting movement between the seat and the column on the one hand and between the seat and the supporting bar on the other hand.

2. A chair according to claim 1, wherein the seat is connected at the front area by at least one rubber pad with a projecting arm of the column which points forward, and at the rear area, the seat is connected by at least one other rubber pad with a lower section of the curved supporting bar, where it is essentially horizontal, and said curved supporting bar being connected to said column along a horizontal transverse axis so that said curved supporting bar can swivel.

3. A chair according to claim 2, wherein the swiveling movement of the curved supporting bar about the hinge point which connects it with the column can be stopped in various relative angle positions with the help of an adjusting device.

4. A chair according to claim 2 further including control means for controlling the swiveling motion impartable to said curved supporting bar so that said swiveling bar can be stopped in various angular positions.

5. A chair according to claim 3, wherein the adjusting device includes a plate with holes and a pin locking mechanism.

6. A chair according to claim 3, wherein the adjusting device includes a pneumatic spring.

7. A chair according to claim 1 further including a rubber buffer between the curved supporting bar and a part of the column for placing the backrest and seat under tension.

8. A chair according to claim 7, wherein said rubber buffer is positioned between an extension of the curved supporting bar which projects forward beyond the hinge point between the column and said supporting bar and the lower side of a plate-shaped part of the projecting arm.

9. A chair according to claim 7, further including means for varying the effect of said rubber buffer.

* * * * *